US009861153B2

(12) United States Patent
Finisdore

(10) Patent No.: US 9,861,153 B2
(45) Date of Patent: Jan. 9, 2018

(54) PROTECTIVE HEADGEAR WITH NON-RIGID OUTER SHELL

(71) Applicant: PRO-TEKT ATHLETIC SCIENCES, INC., Bala Cynwyd, PA (US)

(72) Inventor: Joseph Anthony Finisdore, Bala Cynwyd, PA (US)

(73) Assignee: PRO-TEKT ATHLETIC SCIENCES, INC., Bala Cynwyd, PA (US)

( * ) Notice: Subject to any disclaimer, the term of this patent is extended or adjusted under 35 U.S.C. 154(b) by 0 days.

(21) Appl. No.: 15/478,826

(22) Filed: Apr. 4, 2017

(65) Prior Publication Data

US 2017/0280811 A1 Oct. 5, 2017

Related U.S. Application Data

(60) Provisional application No. 62/317,838, filed on Apr. 4, 2016.

(51) Int. Cl.

| | |
|---|---|
| ***A42B 3/06*** | (2006.01) |
| ***A42B 3/12*** | (2006.01) |
| *A63B 71/10* | (2006.01) |

(52) U.S. Cl.

CPC ..... *A42B 3/069* (2013.01); *A42B 3/062* (2013.01); *A42B 3/127* (2013.01); *A63B 71/10* (2013.01); *A63B 2243/0025* (2013.01)

(58) Field of Classification Search

CPC ..... A42B 3/003; A42B 3/128; A42B 3/127; A42B 3/069; A42B 3/125; A42B 3/061; A42B 3/063; A42B 3/064; A42B 1/00

USPC ..... 2/410, 425, 412, 411, 414

See application file for complete search history.

(56) References Cited

U.S. PATENT DOCUMENTS

| | | | | |
|---|---|---|---|---|
| 5,493,736 | A | 2/1996 | Allison | |
| 5,832,541 | A | 11/1998 | Rock | |
| 6,070,271 | A * | 6/2000 | Williams | A42B 3/066 2/412 |
| 6,154,889 | A | 12/2000 | Moore, III et al. | |
| 6,346,210 | B1 * | 2/2002 | Swartz | A43B 3/28 264/320 |
| 6,934,971 | B2 | 8/2005 | Ide et al. | |
| 7,328,462 | B1 * | 2/2008 | Straus | A42B 3/067 2/411 |
| 8,182,909 | B2 * | 5/2012 | Schneider | C08G 18/10 106/287.26 |
| 8,230,527 | B2 | 7/2012 | Jeong et al. | |

(Continued)

*Primary Examiner* — Gloria Hale
(74) *Attorney, Agent, or Firm* — Wendy W. Koba

(57) ABSTRACT

Protective headgear apparatus (such as a helmet used for contact sports) is formed to comprise a non-rigid outer shell in the form of multiple layers of open-cell foam, each layer having a different density. A flexible, lightweight metal frame (i.e., a "cage") is disposed to contact the inner surface of the outer shell (i.e., bonded in a manner that essentially "locks" the frame to the foam layer), and an open-cell foam cushion layer (in a waffle-like pattern) is bonded to the exposed surface of the metal frame. The various foam layers are preferably impregnated with activated carbon particles that electrostatically absorb (i.e., "capture") the energy caused by blows to the outer shell. The captured energy is thereafter distributed throughout the volume of the foam layer itself, so as to minimize the amount of energy that reaches the wearer's head.

15 Claims, 5 Drawing Sheets

(56) References Cited

U.S. PATENT DOCUMENTS 8,296,867 B2 * 10/2012 Rudd ..... A42B 3/062 2/410
8,499,366 B2 8/2013 Nimmons et al.
8,776,272 B1 7/2014 Straus et al.
8,782,819 B1 * 7/2014 Culpepper ..... A42B 3/10 2/410
8,938,818 B2 1/2015 Ide et al.
9,314,061 B2 * 4/2016 Hanson ..... A42B 3/003
9,370,215 B1 * 6/2016 Straus ..... A42B 3/003
9,400,423 B2 * 7/2016 Arai ..... G03F 1/68
2006/0070170 A1 * 4/2006 Copeland ..... A41D 31/0044 2/411
2006/0070171 A1 * 4/2006 Copeland ..... A41D 31/005 2/455
2006/0162054 A1 * 7/2006 Lardeau ..... A42B 3/127 2/414
2006/0242752 A1 * 11/2006 Talluri ..... A42B 3/063 2/412
2006/0260026 A1 * 11/2006 Doria ..... A42B 3/127 2/414
2007/0000032 A1 * 1/2007 Morgan ..... A42B 3/128 2/412
2007/0130673 A1 * 6/2007 Wasserkrug ..... A42B 1/08 2/411
2008/0052808 A1 * 3/2008 Leick ..... A42B 3/003 2/411
2008/0066217 A1 * 3/2008 Depreitere ..... A42B 3/064 2/412
2009/0031479 A1 2/2009 Rush, III
2009/0260133 A1 * 10/2009 Del Rosario ..... A42B 3/063 2/412
2010/0287687 A1 * 11/2010 Ho ..... A42B 3/061 2/411
2010/0306904 A1 * 12/2010 Neid ..... A42B 1/08 2/414
2010/0319109 A1 * 12/2010 Field ..... A42B 3/08 2/421
2011/0113538 A1 * 5/2011 von Blucher et al. ... A43B 1/00 2/456
2011/0209272 A1 * 9/2011 Drake ..... A42B 3/069 2/411
2011/0271428 A1 11/2011 Withnall et al.
2012/0317705 A1 12/2012 Lindsay
2013/0247285 A1 9/2013 Bartsch et al.
2014/0075652 A1 * 3/2014 Hanson ..... A42B 3/127 2/411
2014/0223644 A1 8/2014 Bologna et al.
2014/0373257 A1 * 12/2014 Turner ..... A42B 3/125 2/414
2015/0040296 A1 * 2/2015 Hanson ..... A42B 3/069 2/411
2015/0101899 A1 * 4/2015 Russo ..... B29C 67/0059 188/266
2015/0128330 A1 * 5/2015 Mumme ..... A42B 3/003 2/244
2015/0135414 A1 5/2015 Ide et al.
2015/0216247 A1 * 8/2015 Price ..... A42B 3/069 2/414
2015/0237946 A1 * 8/2015 Simpson ..... A42B 3/124 2/414
2015/0272258 A1 * 10/2015 Preisler ..... A42B 3/127 2/412
2017/0127748 A1 * 5/2017 Sethumadhavan .... A42B 3/063
2017/0196290 A1 * 7/2017 Scanlon ..... A42B 3/062
2017/0196291 A1 * 7/2017 Glover ..... A42B 3/063
2017/0196292 A1 * 7/2017 Reinhall ..... A42B 3/063

* cited by examiner

PROTECTIVE HEADGEAR WITH NON-RIGID OUTER SHELL

CROSS-REFERENCE TO RELATED APPLICATIONS

This application claims the benefit of U.S. Provisional Application Ser. No. 62/317,838, filed Apr. 4, 2016 and herein incorporated by reference.

TECHNICAL FIELD

The present invention relates to protective headgear, such as a helmet for contact sports or recreational activities and, more particularly, to protective headgear having a non-rigid outer shell, a lightweight metal frame, and interior cushioning, combined in a manner to lessen the risks of head and neck injuries to the wearer.

BACKGROUND OF THE INVENTION

It has become well-known and widely reported that there has been an increase in head, neck and brain injuries sustained by athletes engaged in contact sports such as football, hockey, lacrosse, and the like.

While there have been many attempts to address this concern, such as by incorporating various types of shock absorbing material within the helmet, webbing within the helmet, modular components located at strategic areas of the helmet, etc., every contemplated modification remains based on the utilization of the hard plastic outer shell as a basic and necessary component of the helmet structure.

SUMMARY OF THE INVENTION

The limitations in the prior art are addressed by the present invention, which relates to protective headgear (used, for example, in any type of contact sport or recreational activity) that eliminates the need to use a hard plastic outer shell.

In accordance with the present invention, an exemplary protective headgear apparatus (hereinafter referred to as a "helmet") is formed to comprise a non-rigid outer shell in the form of multiple layers of open-cell foam, each layer having a different density. A flexible, lightweight metal frame (i.e., a "cage") is disposed to contact the inner surface of the outer shell (i.e., bonded in a manner that essentially "locks" the frame to the foam layer), and an open-cell foam cushion layer (in a waffle-like pattern) is bonded to the exposed surface of the metal frame.

The various foam layers are preferably impregnated with activated carbon particles that electrostatically absorb (i.e., "capture") the energy caused by blows to the outer shell. The captured energy is thereafter distributed throughout the volume of the foam layer itself, so as to minimize the amount of energy that reaches the wearer's head.

In some embodiments of the present invention, various styles of face mask, formed of a tensile strength metal alloy, may be welded or bolted to the headframe and, therefore, also be capable of withstanding severe contact blows. In preferred embodiments, the face mask is fitted with a shatter-proof, ventilated, acrylic shield to create a smooth surface over the mask and prevent opposing players from the grabbing the mask (intentionally or unintentionally), thus minimizing the possibility of serious neck injuries.

One exemplary embodiment takes the form of protective headgear apparatus comprising: a plurality of layers of open-cell foam forming a multi-layer, non-rigid outer shell, a lightweight metal frame forming a desired headgear configuration, with the multi-layer, non-rigid outer shell disposed over and covering the lightweight metal frame, and an inner cushion component coupled to exposed underside of the lightweight metal frame and disposed to cover at least portions of the lightweight metal frame associated with selected areas of a user's head.

Other and further embodiments of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION OF THE INVENTION

In accordance with the present invention, the use of a non-rigid, foam-based, multilayer outer shell functions to spread the energy associated with a "hit" across a larger surface area of the protective headgear (hereinafter referred to as "helmet") than could be achieved with the prior art hard plastic shell helmet. Additionally, one or more of the layers of the outer shell is impregnated with activated carbon particles to enhance the energy absorption. Alternatively, a separate layer of the activated carbon may be disposed between adjacent foam layers. A cage-like frame of a lightweight metal composition (e.g., aluminum or an aluminum alloy) is positioned between the non-rigid outer shell and an interior cushion (the cushion resting against the user's head). The frame functions, in accordance with the present invention, to further dissipate the energy associated with a blow to the helmet, reflecting some of the energy outward and away from the player. In some embodiments, the frame may be formed to include an integral face mask element. The details of the inventive design will now be explained below in association with the provided drawings.

Figure 1:
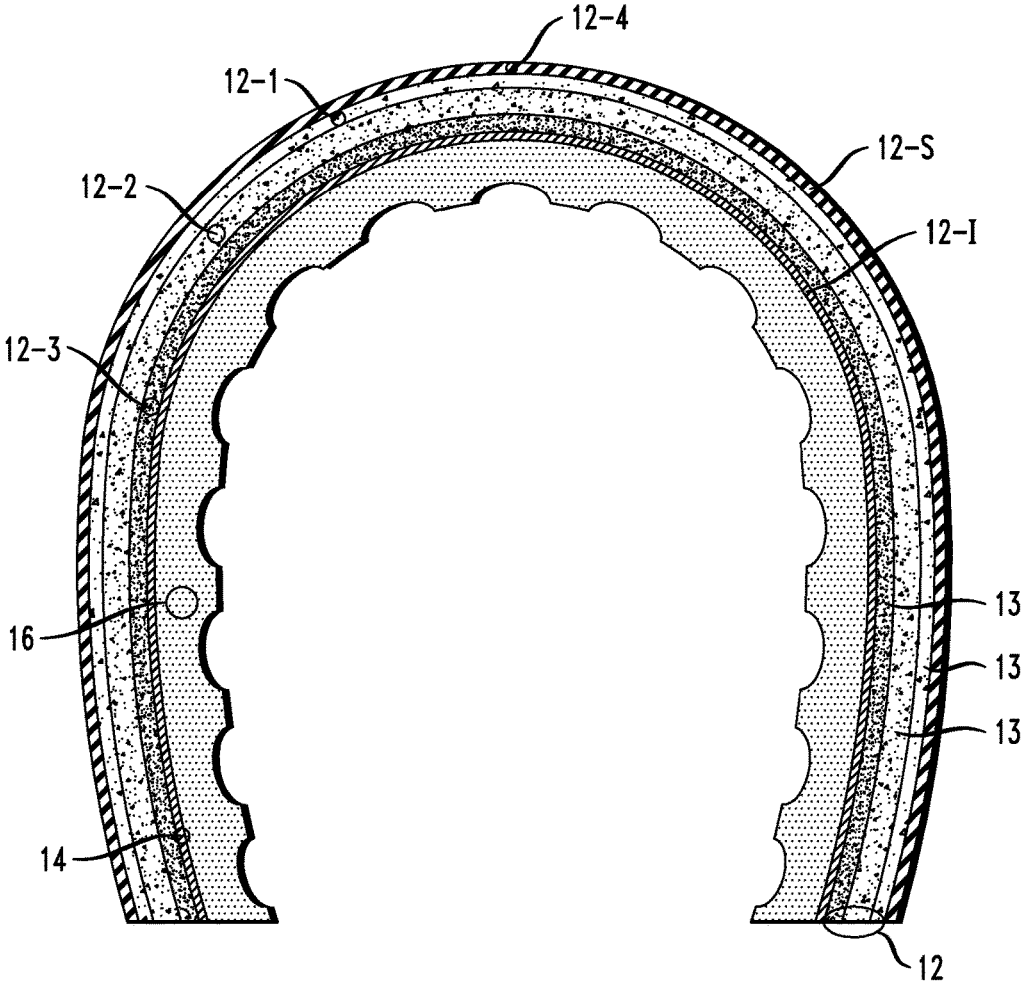
FIG. 1 is a cut-away, simplified view of the various layers of material used to form non-rigid protective headgear in accordance with the principles of the present invention.

FIG. 1 is a cut-away, simplified view of the various layers of material used to form a non-rigid helmet 10 in accordance with the present invention. The helmet itself is intended for use in any type of contact sport (e.g., football, ice hockey, lacrosse, etc.) or recreational activity where an individual may suffer head injuries (e.g., cycling, skate boarding, zip-lining, etc.). It is to be understood that the composition and configuration of the non-rigid helmet itself remains essentially the same, regardless of the activity of the individual wearing the non-rigid helmet. The major components of helmet 10 include a non-rigid outer shell 12, a lightweight metal frame 14 and an inner cushion 16. In the specific embodiment illustrated in FIG. 1, non-rigid outer shell 12 includes a set of three layers to form the "multiple layer" structure (it is to be understood that more layers may be included, remaining mindful of the overall size of the final product). Each layer is formed of an open-cell foam and preferably includes activated carbon particles.

In particular, the multiple layers of non-rigid outer shell 12 are organized such that they increase in density from outer surface 12-S to inner surface 12-I. For example, a first layer 12-1 may comprise an open-cell foam having a density in the range of 20-40%, a second layer 12-2 may comprise an open-cell form having a density in the range of 40-60%, and a third layer 12-3 may comprise an open-cell foam having a density in the range of 60-80%. These values are all considered to be exemplary only, and other combinations of density (as well as other numbers of separate layers) may be used in the formation of non-rigid outer shell 12.

In the fabrication of this multi-layer non-rigid outer shell, a flexible coating 12-4 (e.g., vinyl or another appropriate plastic) may be included on the outer surface 12-S of shell 12. Flexible coating 12-4 is useful in allowing various coloring designs and combinations (including team logos) to be presented on the surface of the helmet. It is to be understood that by its nature of being "flexible", coating 12-4 is also non-rigid and, therefore, does not affect the energy absorption properties of non-helmet 10. In one embodiment, layer 12-1 was formed to have a thickness of about a quarter inch, with layer 12-2 also formed of a quarter-inch thickness and layer 12-3 having a thickness on the order of three-eighths of an inch (i.e., an overall thickness of non-rigid outer shell 12 being less than one inch).

In further accordance with the present invention, at least one layer of non-rigid outer shell 12 is formed to include activated carbon particles 13. Activated carbon particles 13 function to electrostatically absorb the energy associated with forces applied to the helmet (i.e., from contact with another player, other equipment, hitting the ground when falling, etc.). Indeed, the individual activated carbon particles 13 capture the incoming energy, and then function to instantly re-direct this energy across the surface (and into the volume) of the associated foam layer, preventing most, if not all, of this energy from reaching the individual's head. As a result of the presence of carbon particles 13, the energy associated with these externally-applied forces is maintained at a safe distance and well-separated from the wearer's head and neck.

It is to be understood that the specific number of open cell foam layers used to form non-rigid outer shell 12 may vary, as well as the specific densities of each layer. However, it is preferred that the density of each layer increases in the direction from the exterior to the interior of the helmet.

Lightweight metal frame 14 integrates with layer 12-3 upon formation. In a preferred embodiment, frame 14 comprises aluminum or an aluminum alloy. Aluminum is known to be a lightweight, high tensile strength metal that is capable of redirecting applied forces, in this case functioning in a spring-like manner to re-direct the absorbed energy back into outer shell 12. In one exemplary embodiment, a magnesium-aluminum alloy was utilized, which exhibited an appropriate flexibility, while only having a thickness on the order of 3/16". Other materials may be used in combination with aluminum, such as scandium (or a combination of magnesium and scandium). In accordance with the present invention and as mentioned above, frame 14 is sufficiently flexible so that it reacts upon receiving an impact by springing back and deflecting the energy in the opposite direction; that is, deflecting the energy back into the multiple layers forming non-rigid outer shell 12. It is to be understood that aluminum alloy frame 14 is a primary element of the inventive helmet that prevents fractures by directing absorbed energy away from the individual's head and back into the outer shell 12.

Inner cushion 16, as shown in FIG. 1, forms the interior surface of non-rigid helmet 10. In an exemplary embodiment, inner cushion 16 comprises a relatively thick layer (or segments) of open-cell foam formed to exhibit a waffle-like pattern. The waffle pattern promotes air circulation and functions to wick moisture away from the head. In some configurations, inner cushion 16 may be separable from the remaining components of the helmet, so that it may be cleaned or replaced, as need be. As will be discussed below and illustrated in various other ones of the drawings, inner cushion 16 may comprise a single layer of cushioning material formed to cover aluminum alloy frame 14, or may comprise several sections of cushion material disposed at predetermined locations to cover specific parts of the head and neck. Yet again, frame 14 itself may be formed as embedded within inner cushion 16 or, alternatively, removable from the combination of outer shell 12/frame 14. All of these variations will be discussed below.

Figure 2:
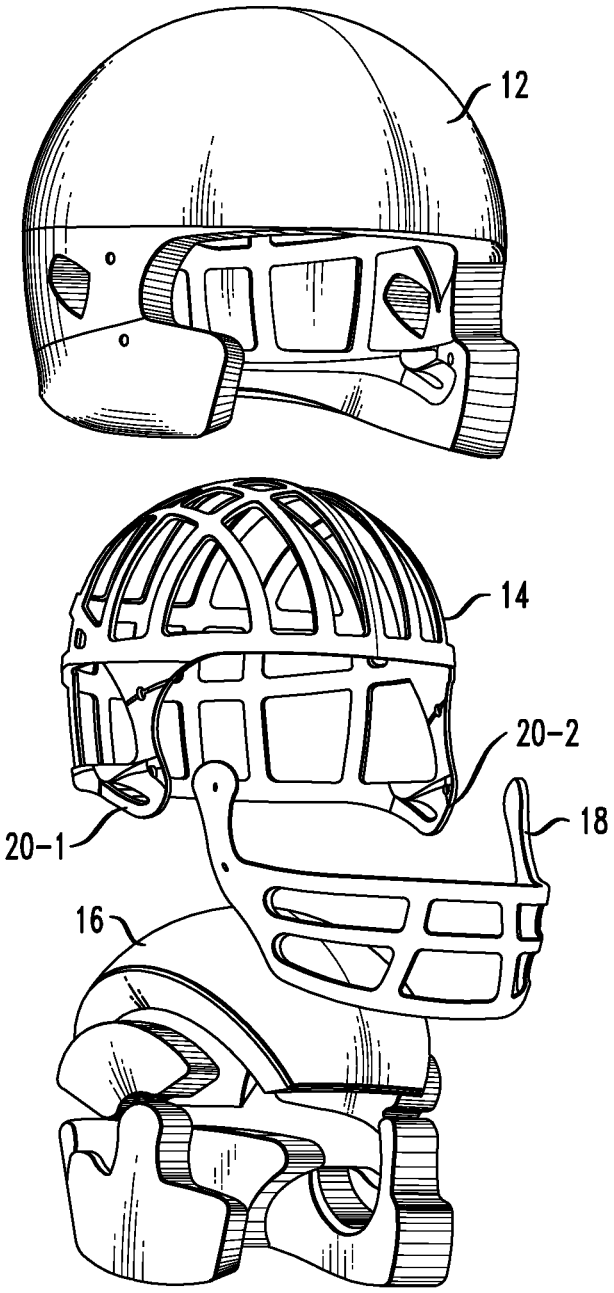
FIG. 2 is an exploded, isometric view of the three elements forming the inventive headgear of the present invention.

FIG. 2 is an exploded, isometric view of the three elements forming the inventive helmet of the present invention, showing non-rigid outer shell 12, lightweight metal frame 14, and inner cushion 16. In this particular embodiment, frame 14 is formed as a cage-like structure that covers the forehead area, as well as the top, sides and back of the head. Here, a separate face mask 18 is used, where face mask 18 is preferably formed of a lightweight, high tensile strength material (perhaps the same aluminum or aluminum alloy as used for frame 14 in some embodiments). In formation, face mask 18 is bolted, screwed, or otherwise secured to frame 14. Exemplary attachment locations 20-1 and 20-2 on frame 14 are shown in FIG. 2.

Inner cushion 16 is also shown in FIG. 2. Inner cushion 16 rests against the player's head and minimizes the jarring motion to the brain—a known cause of concussions. In the particular embodiment shown in FIG. 2, inner cushion 16 is formed as a continuous layer of absorbing material (such as, for example, open-cell foam) which is placed against and attached to frame 14. The attachment itself may be releasable so that inner cushion 16 may be removed and washed (or replaced), as necessary. In preferred configurations, the open-cell foam material is formed to include a waffle pattern, which allows for air circulation, as well as the absorption of moisture, increasing player comfort.

Figure 3:
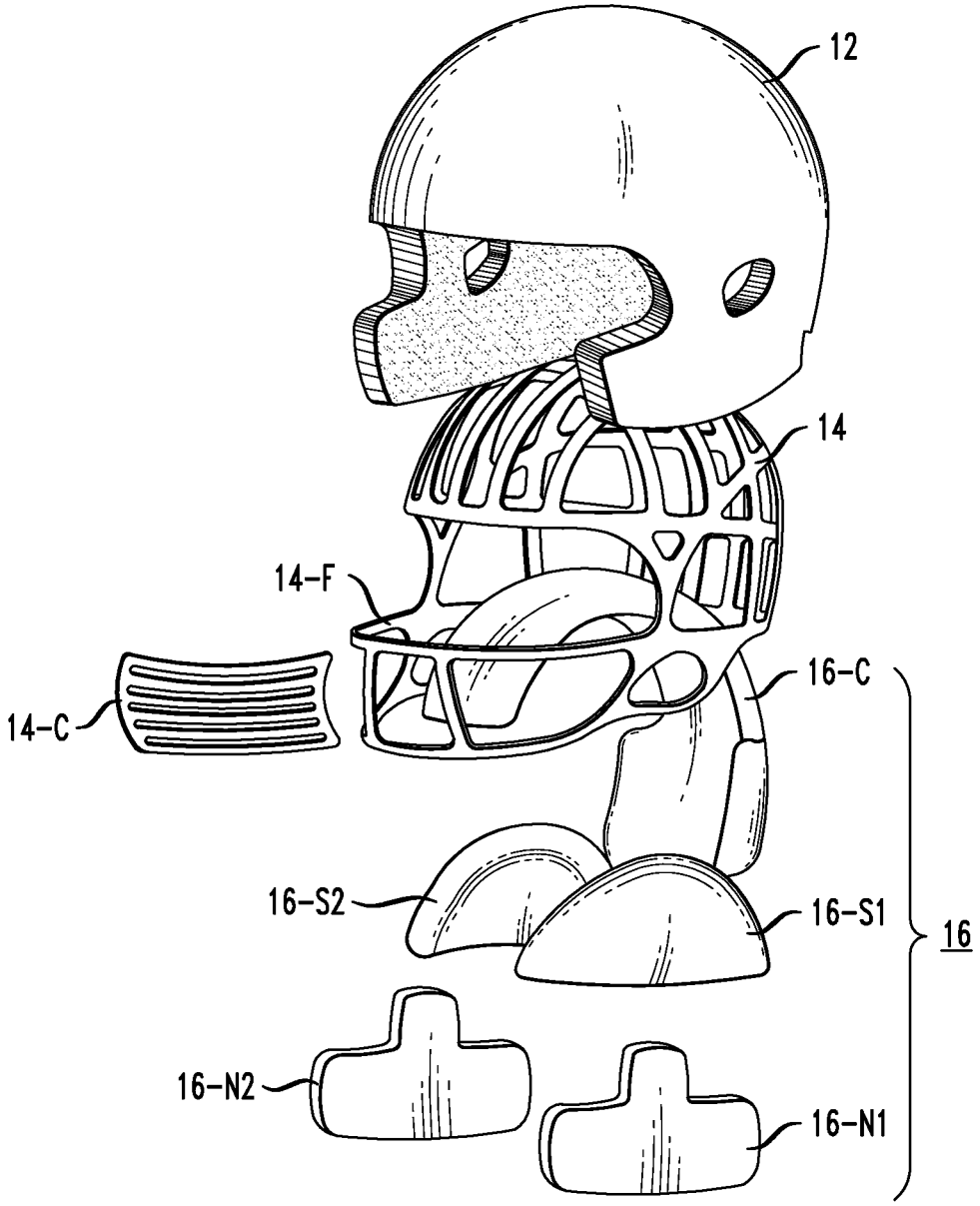
FIG. 3 is an exploded view of an alternative embodiment of the present invention.

FIG. 3 is an exploded view of an alternative embodiment of the present invention, in this case incorporating the face mask as an integral portion of the frame. This alternative embodiment also utilizes separate sections of foam material to form internal cushion 16. Referring to FIG. 3, non-rigid outer shell 12 comprises multiple layers of open-cell foam (preferably of increasing density), with one or more layers including activated carbon particles 13 that function to absorb and re-direct energy.

Lightweight metal frame 14 is again shown as comprising a cage-like structure that protects the head, including the forehead and neck regions. As mentioned above, in this particular embodiment, frame 14 further includes a forward portion that serves as a face mask 14-F. By virtue of integrating the face mask with frame 14, the possibilities of injuries associated with the facemask are further reduced. That is, the incorporation of the face mask with the helmet frame eliminates the bulky face masks bolted to helmets. In a preferred embodiment, face mask 14-F is covered with a clear acrylic coating 14-C (including a number of small ventilation holes), where coating 14-C is considered to further limit the ability of an opposing player to "grab" the face mask framework.

In this particular embodiment of the present invention, as shown in FIG. 3, inner cushion 16 is formed of several different segments, including a central portion 16-C that extends from the neck area upward over the central region of the head, covering at least a portion of the forehead. Side portions 16-S1 and 16-S2 of cushion 16 will rest against opposing sides of the face, with neck portions 16-N–1 and 16-N2 positioned adjacent to the neck.

Figure 4:
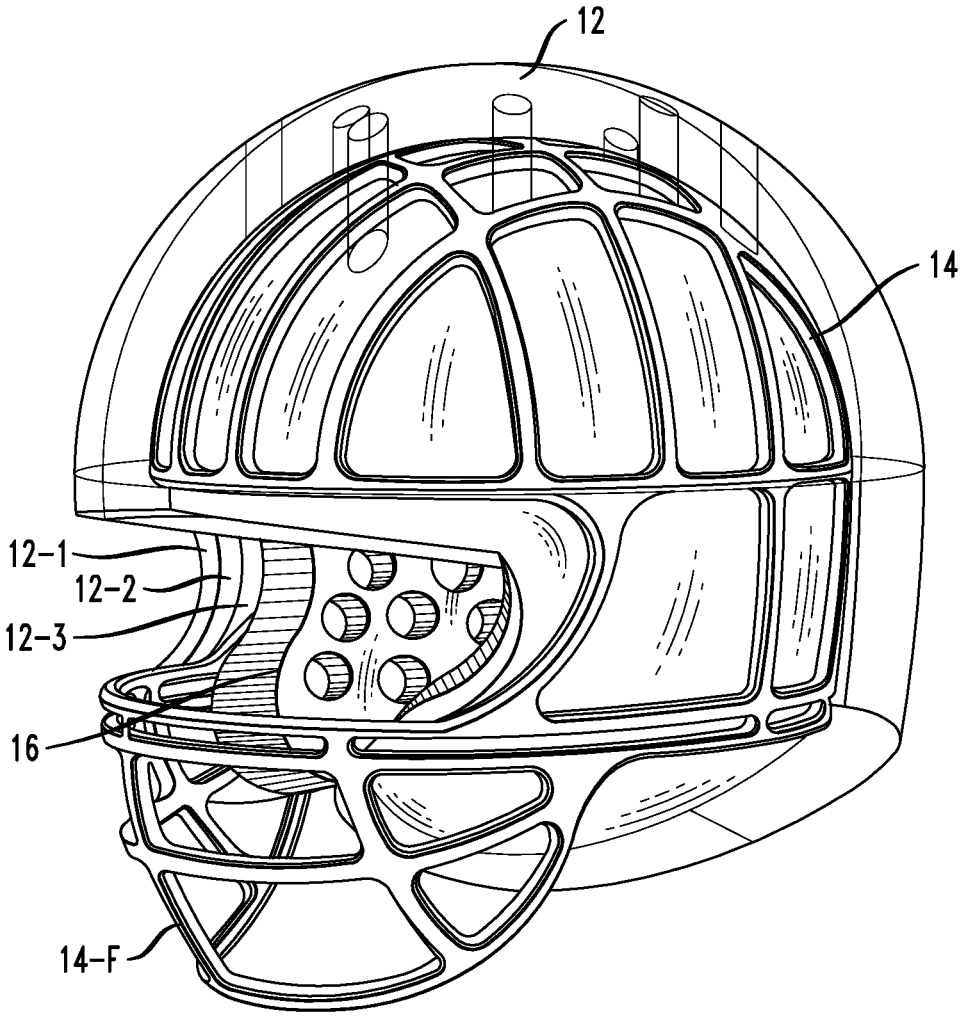
FIG. 4 is a side view of an exemplary embodiment of a non-rigid helmet formed in accordance with the present invention, again showing the locations of the three components used to form the helmet.

FIG. 4 is a side view of an exemplary embodiment of non-rigid helmet 10, again showing the locations of the three components used to form helmet 10, in this view showing the combination of components as fitted together to form the final structure. In this particular view of FIG. 4, frame 14 is shown as including the integral face mask element 14-F.

It is to be understood that the inventive helmet relies on the interworking and cooperation of all three elements; forming a "matrix" structure that is able to receive hits and absorb energy in a manner far superior to prior art helmets that are based on the standard hard plastic outer shell. Indeed, the configuration of the present invention as shown and described will absorb, dissipate and deflect a significant portion of the impact energy caused by violent contact before the energy reaches the player's head. The flexibility of non-rigid outer shell 12 causes the energy from an impact to immediately fan out, dispersing the energy in a wide radius. The changes in density through the various layers forming shell 12 changes the propagation speed of the energy (i.e., slowing down the movement of the energy toward the head). The inclusion of lightweight metal frame 14 further disrupts the flow of the remaining energy, spreading the impact across the surface of frame 14. By virtue of its flexibility, frame 14 functions as a spring-like member, "kicking" the energy back into multi-layer outer shell 12, thus further minimizing the forces felt by the player.

As mentioned above, inner cushion 16 is preferably formed of an open cell foam having a waffle-like pattern, and fits closely to the player's head. Its contribution to the design is to cushion the player's head, preventing any residual impact force or energy from reaching the brain. Advantageously, the waffle pattern allows air to circulate and absorb moisture, increasing player comfort. In a preferred embodiment, inner cushion 16 is removable from the helmet structure, so that it can be replaced if it gets wet, becomes torn, etc.

Figure 5:
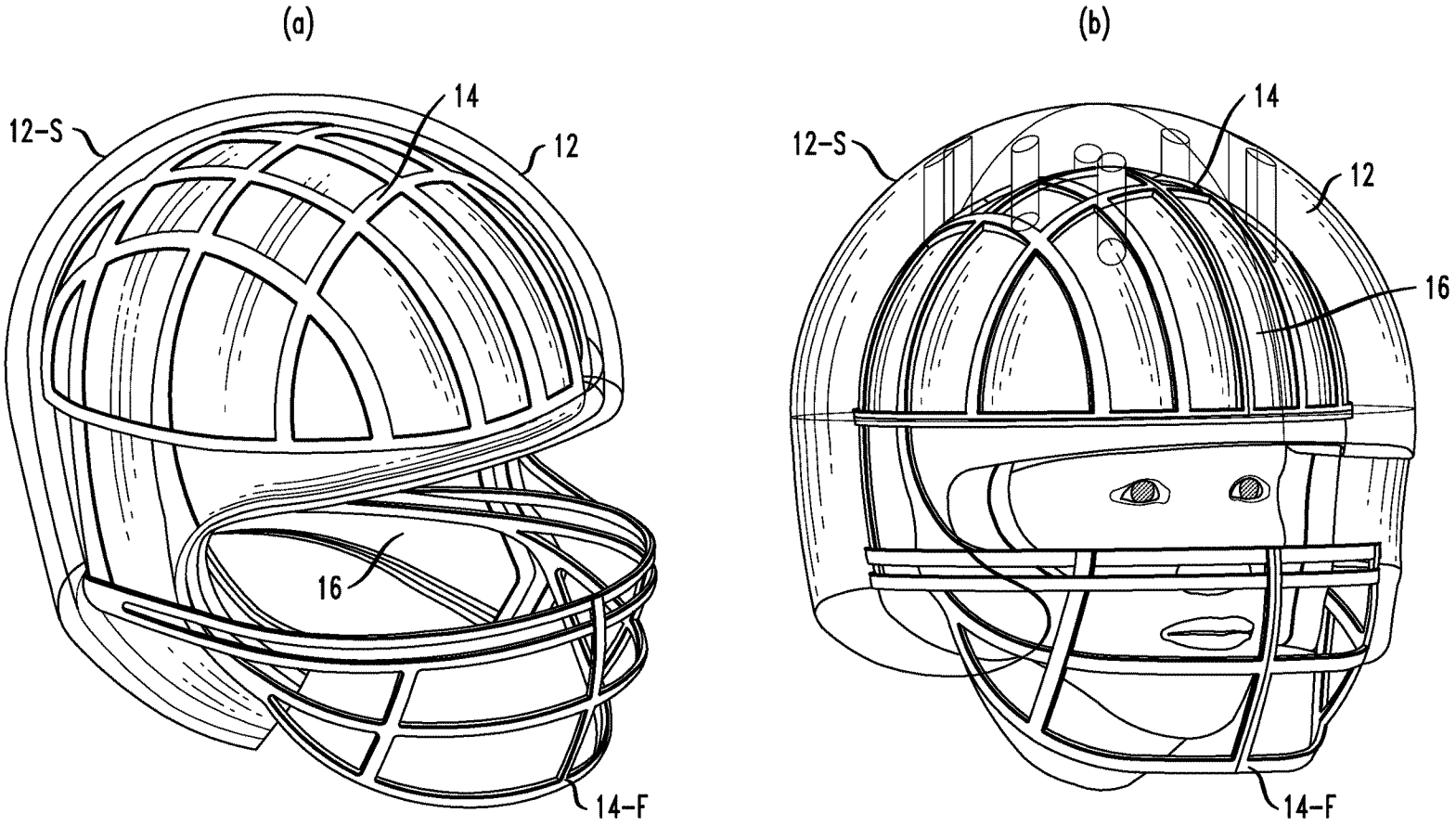
FIG. 5 includes additional views of a non-rigid helmet formed in accordance with the present invention, with FIG. 5(*a*) illustrating the various components and FIG. 5(*b*) depicting the same non-rigid helmet as in position over an individual's head.

FIG. 5 includes another view of non-rigid helmet 10 formed in accordance with the present invention. In this case, FIG. 5(*a*) illustrates the various components including outer shell 12, lightweight metal frame 14 (including an integral face mask 14-F), and inner cushion 16 as combined together in their final, as-fabricated, form. FIG. 5(*b*) depicts the same non-rigid helmet 10 as positioned over an individual's head. In this view, the various layers forming outer shell 12 are indicated in "phantom", allowing for a better view of underlying frame 14 and inner cushion 16. In this particular embodiment, inner cushion 16 is formed as a single element that completely covers the inner surface of lightweight metal frame 14.

Summarizing, the present invention describes a helmet that does not use a rigid plastic outer shell. The inventive design relies instead of an alternative foundation, one that does not transmit forced energy to the player's head. The inventive helmet consists of a three-part matrix formulation: (1) a one-piece, open metal framework of flexible, lightweight material that covers the head. This framework is encased solidly between (2) a thick outer padding (open-cell foam layers of increasing density, preferably incorporating activated carbon particles) that covers the entire framework and (3) an inner foam cushion that surrounds the player's head.

This configuration, in accordance with the present invention, is able to absorb and dissipate a significant portion of the energy produced by an initial impact, as associated with contact from an opposing player (or object). This is possible as a result of the performance qualities of the specific materials used to form each component of the three-part matrix formulation.

As described above, although the present invention has been explained by way of limited examples, the present invention is not intended to be limited thereby, and any person having ordinary skill in the art to which the present invention pertains will be able to carry out various modifications that are considered to fall within the spirit and scope of the present invention. Indeed, the scope of the present invention is intended to be limited only by the metes and bounds of the claims as appended hereto.

What is claimed is:

1. Protective headgear apparatus comprising:

a plurality of layers of open-cell foam forming a multi-layer, non-rigid outer shell;

a flexible metal frame forming a headgear configuration, the flexible metal frame having a top, outer surface and a bottom, inner surface with the multi-layer, non-rigid outer shell attached to the top, outer surface of the flexible metal frame; and an inner cushion component coupled to the bottom, inner surface of the flexible metal frame and disposed to cover at least portions of the flexible metal frame adjacent to selected areas of a user's head.

2. The protective headgear apparatus as defined in claim 1 wherein at least one layer of the plurality of layers of open-cell foam further comprises a plurality of activated carbon particles for additional energy absorption and re-direction of an applied force in an opposite direction.

3. The protective headgear apparatus as defined in claim 1 wherein each layer of the plurality of layers of open-cell foam exhibits a different density, with density increasing from an outer layer to a layer attached to the top, outer surface of the flexible metal frame.

4. The protective headgear apparatus as defined in claim 3 wherein the plurality of layers comprises an outer layer of open-cell foam having a density in the range of 20-40%, a middle layer of open-cell foam having a density in the range of 40-60%, and an inner layer of open-cell foam having a density in the range of 60-80%.

5. The protective headgear apparatus as defined in claim 1 wherein the flexible metal frame comprises an aluminum alloy frame.

6. The protective headgear apparatus as defined in claim 5 wherein the aluminum alloy is selected from the group consisting of scandium-aluminum and magnesium-aluminum.

7. The protective headgear apparatus as defined in claim 1 wherein the flexible metal frame is configured to include a frontal portion for covering and protecting a forehead area.

8. The protective headgear apparatus as defined in claim 1 wherein the flexible metal frame is configured to include an integral face mask portion, the integral face mask portion remaining exposed beyond a termination of the multi-layer, non-rigid outer shell and the inner cushion component.

9. The protective headgear apparatus as defined in claim 8 wherein the headgear apparatus further comprises a ventilated, transparent plastic covering surrounding the exposed integral face mask portion of the flexible metal frame.

10. The protective headgear apparatus as defined in claim 1 wherein the inner cushion component comprises a single element covering at least a portion of the bottom, inner surface of the flexible metal frame.

11. The protective headgear apparatus as defined in claim 1 wherein the inner cushion component comprises a plurality of separate elements, each positioned to provide protection to different areas of a user's head.

12. The protective headgear apparatus as defined in claim 1 wherein the inner cushion component is configured as a removable component.

13. The protective headgear apparatus as defined in claim 1 wherein the inner cushion component comprises an open-foam cell material.

14. The protective headgear apparatus as defined in claim 13 wherein the open-foam cell material exhibits a waffle pattern for providing air circulation.

15. The protective headgear apparatus as defined in claim 1 wherein the apparatus further comprises a flexible outer coating disposed to cover an outer layer of the multi-layer, non-rigid outer shell.

* * * * *